US008144068B2

(12) United States Patent
Thevenard et al.

(10) Patent No.: US 8,144,068 B2
(45) Date of Patent: Mar. 27, 2012

(54) TO PLANAR ANTENNAS COMPRISING AT LEAST ONE RADIATING ELEMENT OF THE LONGITUDINAL RADIATION SLOT TYPE

(75) Inventors: Julian Thevenard, Laiz (FR); Dominique Lo Hine Tong, Rennes (FR); Ali Louzir, Rennes (FR); Corinne Nicolas, La Chapelle des Fougeretz (FR); Jean-Philippe Coupez, Brest (FR); Christian Person, Saint Renan (FR)

(73) Assignee: Thomson Licensing, Boulogne-Billancourt (FR)

( * ) Notice: Subject to any disclaimer, the term of this patent is extended or adjusted under 35 U.S.C. 154(b) by 423 days.

(21) Appl. No.: 12/319,526

(22) Filed: Jan. 8, 2009

(65) Prior Publication Data

US 2009/0262036 A1 Oct. 22, 2009

(30) Foreign Application Priority Data

Jan. 11, 2008 (EP) ..... 0850173

(51) Int. Cl.
*H01Q 13/10* (2006.01)
*H01Q 1/42* (2006.01)

(52) U.S. Cl. ..... 343/767; 343/872; 343/833; 343/834

(58) Field of Classification Search ..... 343/770, 343/767, 872, 833, 834
See application file for complete search history.

(56) References Cited

U.S. PATENT DOCUMENTS 6,043,785 A * 3/2000 Marino ..... 343/767
7,081,865 B2 * 7/2006 Wu et al. ..... 343/872
7,679,575 B1 * 3/2010 Horner et al. ..... 343/770
2006/0061513 A1 3/2006 Sato

OTHER PUBLICATIONS

Kuga N et al: "A bi-directional pattern antenna using short tapered slot antenna" IEEE Antennas and Propagation Society International Symposium. 2001 Digest. APS. Boston, MA, Jul. 8-13, 2001; [IEEE Antennas and Propagation Society International Symposium], New York, NY: IEEE, US, vol. 3, Jul. 8, 2001, pp. 460-463, XP010564325 ISBN: 978-0-7803-7070-8 * Section 3 "Array Antenna" and Figure 6*.

Arai H et al: "Bi-directional notch antenna with parasitic elements for tunnel booster system" Antennas and Propagation Society International Symposium, 1997. IEEE., 1997 Digest Montreal, QUE., Canada Jul. 13-18, 1997, New York, NY, USA IEEE, US, vol. 4, Jul. 13, 1997, pp. 2218-2221, XP010246648 ISBN: 978-0-7803-4178-4 *le document entire*.

Tan-Huat Chio et al: "Parameter Study and Design of Wide-Band Widescan Dual Polarized Tapered Slot Antenna Arrays" IEEE Transactions on Antennas and Propagation, IEEE Service Center, Piscataway, NJ, US, vol. 48, No. 6, Jun. 1, 2000. XP011003798 ISSN: 0018-926X *abrege; figure 1* .

* cited by examiner

*Primary Examiner* — Hoang V Nguyen
(74) *Attorney, Agent, or Firm* — Robert D. Shedd; Harvey D. Fried; James McKenzie

(57) ABSTRACT

The present invention relates to a planar antenna structure comprising at least one radiating element constituted by a longitudinal radiation slot etched onto a substrate. This structure comprises at least one modification element of the radiation pattern positioned in the radiation zone of the radiating element.

10 Claims, 9 Drawing Sheets

TO PLANAR ANTENNAS COMPRISING AT LEAST ONE RADIATING ELEMENT OF THE LONGITUDINAL RADIATION SLOT TYPE

This application claims the benefit, under 35 U.S.C. §119, of European Patent Application No. 0850173 of 11 Jan. 2008.

FIELD OF THE INVENTION

The present invention relates to an improvement to planar antennas, more particularly to antennas comprising at least one radiating element constituted by a longitudinal radiation slot.

BACKGROUND OF THE INVENTION

The increasing development of communication systems, notably wireless, requires the use of increasingly complex and effective systems, while keeping manufacturing costs as low as possible and a minimum size. Now, in this domain, the antennas represent an exception to this possibility of miniaturisation. Indeed, they are subject to the laws of physics that impose a minimum size for operation at a given frequency. Hence, for printed planar antennas, the dimensions are generally in the order of the wavelength at the central operating frequency.

However, it is certain the printed planar structures are structures perfectly suited to a mass production of devices integrating passive and active functions. However, with regard to the radiating elements, a planar structure does not enable a full control of the radiation of the antenna, particularly in elevation. Moreover, the directivity and angular opening of the main lobe of the radiation pattern of the antenna are directly linked to the dimensions of the antenna that it is necessary to increase to obtain a significant directivity and a large opening of the main lobe.

The present invention therefore proposes an antenna structure in which the radiation pattern of the antenna can be modified and optimised without, however, modifying the physical dimensions of the antenna structure.

SUMMARY OF THE INVENTION

Hence, the present invention relates to a structure for a slot type antenna comprising on a substrate at least one radiating element constituted by a longitudinal radiation slot and a feed line, said substrate being surrounded by a radome, characterized in that at least one modification element of the radiation pattern is positioned on the radome in the radiating zone of the radiating element.

This modification element of the radiation pattern is constituted by a conductive element positioned in a plane extending the plane of the substrate or plane E. This conductive element can be positioned perpendicularly to the axis of symmetry of the radiating element or shifted angularly with respect to this axis of symmetry or with respect to an axis perpendicular to this axis of symmetry.

According to another characteristic of the present invention, another modification element of the radiation pattern is constituted by a conductive element positioned in a plane perpendicular to the plane of the substrate or plane H. These conductive elements can be combined with each other and present a projecting element acting on the impedance matching parameters of the radiating element.

The conductive element is constituted by a metal rod or strip

According to a preferential embodiment, the antenna structure is constituted by N (N>1) radiating elements realised on N substrates interconnected according to a common axis perpendicular to the radiating axis of each radiating element, each radiating element being associated with at least one modification element of the radiating pattern positioned in the radiating zone of the radiating element, as mentioned above.

BRIEF DESCRIPTION OF THE DRAWINGS

Other characteristics and advantages of the invention will appear upon reading the description of different embodiments, this reading being realized with reference to the enclosed drawings, wherein.

To simplify the following description, the same elements have the same references as the figures.

DESCRIPTION OF PREFERRED EMBODIMENTS

The present invention will be described by taking as radiating element constituted by a longitudinal radiation slot, an LTSA (Linearly Tapered Slot Antenna) type antenna such as a Vivaldi antenna. It is evident that the invention can be applied to other types of longitudinal radiation antennas.

Figure 1:
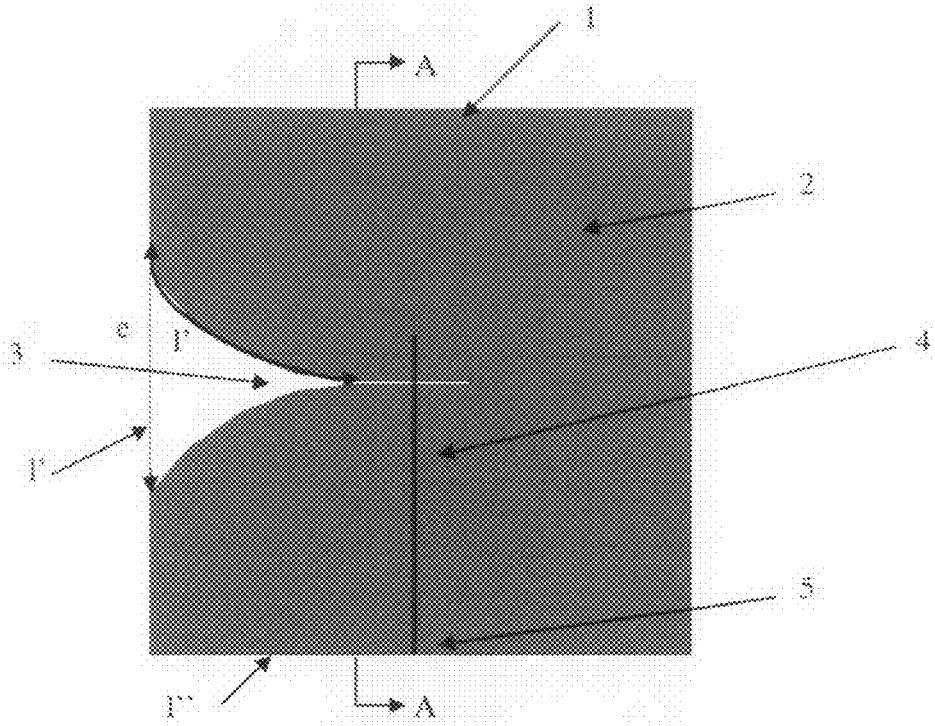
FIG. 1 is a schematic plan representation of a Vivaldi type antenna used in the present invention.
Figure 2:
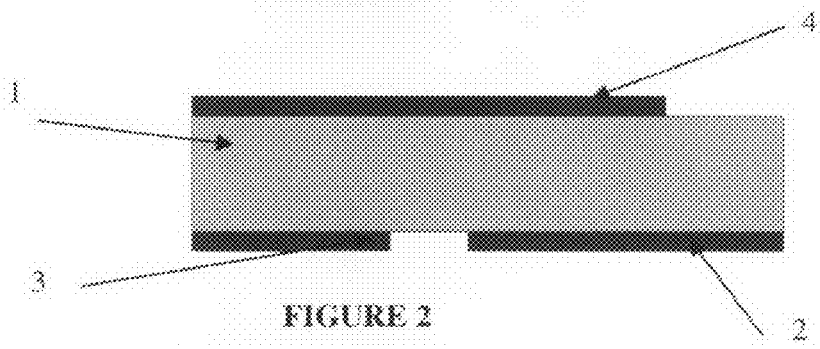
FIG. 2 is a cross-section view along A-A of FIG. 1.

As shown in FIGS. 1 and 2, an antenna of this type is obtained by etching on a substrate 1, a slot 3 that gradually enlarges up to an edge 1' of the substrate. On the other side of the substrate 1, a microstrip line 4 is etched enabling the excitation by electromagnetic coupling of said slot. Other types of feed can be considered without leaving the scope of the invention, particularly a feed by coplanar line.

As shown in FIG. 1, the excitation line 4 is extended up to one 1" of the edges of the substrate 1 to obtain an access point 5. This type of antenna gives an excellent impedance matching over a wide frequency band. Hence, it has been shown that, according to a first approach, the directivity of an LTSA antenna can be determined as follows:

The opening at 3 dB of the beam radiating in the plane E (plane containing the substrate) is inversely proportional to the width of the opening (e).

The opening at 3 dB of the beam in the plane H (plane perpendicular to the plane E) is inversely proportional to the length of the profile (I).

To modify the radiation pattern of an antenna of this type, without playing with the dimensions of the antenna, it is proposed, in accordance with the present invention, to use conductive elements, more particularly metal rods or strips that modify the behaviour of the antenna, particularly with regard to its radiation pattern.

Figure 3:
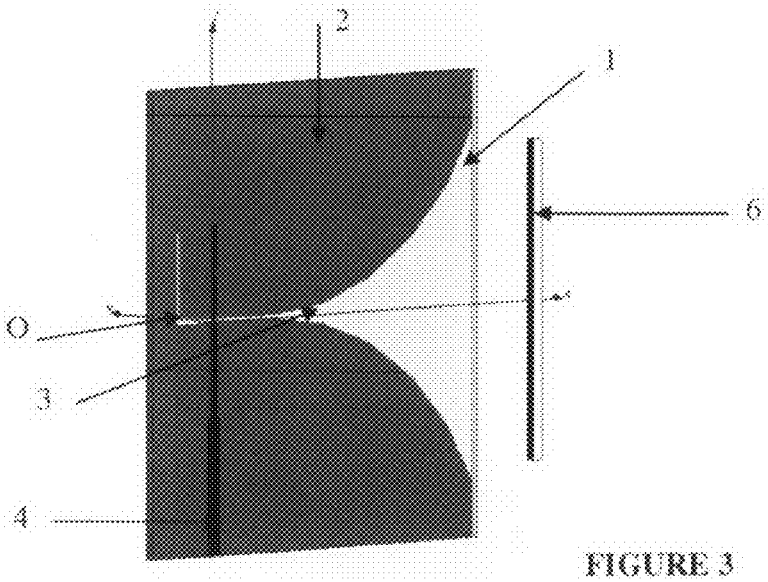
FIG. 3 is a schematic perspective view of a first embodiment of an antenna structure featuring a modification element of the radiation pattern.

Hence, as shown in FIG. 3, a metal rod 6 is positioned perpendicularly to the axis of symmetry of the slot part 3 of the antenna, namely the axis Ox in the embodiment shown. FIG. 3 shows a Vivaldi type antenna similar to the antenna of FIG. 1 associated with a vertical element 6 realised in the plane of the substrate, namely the plane E of the antenna.

As shown on the FIG. 3, this vertical element is not realised on the substrate 1, but in a radiation plane of the Vivaldi antenna, extending the plane of the substrate. The vertical element or elements can be positioned on an element surrounding the antenna such as a radome.

An antenna of this type was simulated by using elements 6 of different lengths. The antenna simulated using the HFSS commercial software based on a frequency method of finite elements, has the following characteristics: FR4 type substrate of thickness 0.67 mm, (Er=4.4 and Tan D=0.02), antenna with circular profile of length 33 mm and aperture 33 mm, total dimensions of the antenna: 44 mm high*41 mm long. The results of the simulations are given by FIG. 4 that shows the impedance matching of the antenna and by the FIGS. 5 and 6 that respectively show the radiation pattern in the elevation plane ($\Phi=0°$, plane XoZ) and in the azimuthal plane, at ($\theta=90°$, plane XoY).

In these different figures, the curves A represent a Vivaldi type antenna alone. The curves B show a Vivaldi type antenna in the presence of an element 6 having a length of 30 mm, namely a length greater than $\lambda/2$, and the curve C, an antenna in the presence of an element 6 of length 20 mm, namely a length less than $\lambda/2$ where $\lambda$ is the wavelength of the operating frequency of the antenna.

Figure 4:
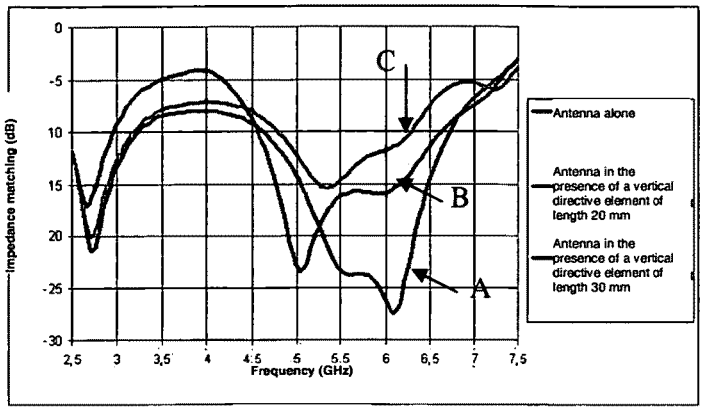
FIG. 4 shows a curve giving the impedance matching of the antenna as a function of the frequency, respectively for an antenna alone (curve A), for an antenna in the presence of a directive element of length 30 mm (curve B) and for an antenna in the presence of a directive element of length 20 mm (curve C).
Figure 5:
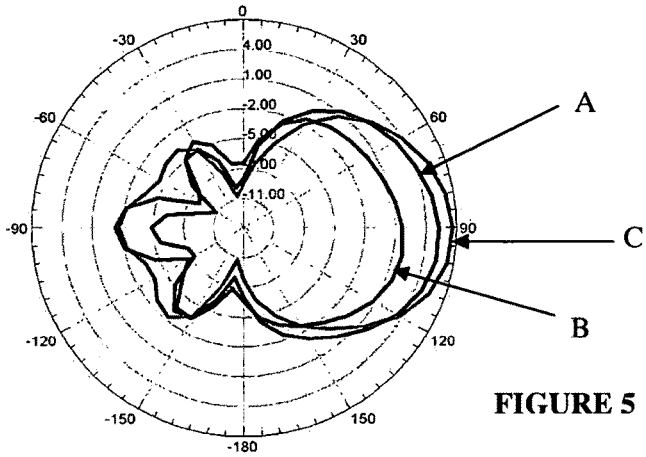
FIG. 5 shows the radiation pattern in the elevation plane for the different antenna structures mentioned above.
Figure 6:
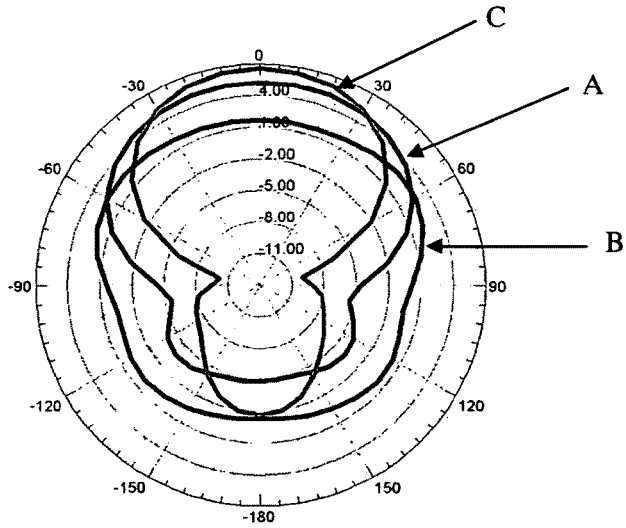
FIG. 6 shows the radiation pattern in the azimuthal plane for the different antenna structures mentioned above.

The results of FIGS. 5 and 6 show that an element of length greater than $\lambda/2$ behaves as a reflector, whereas an element of length less than $\lambda/2$ behaves as a directive element. This applies when the aperture e of the slot has a length greater than or equal to $\lambda/2$. Otherwise, the conductive element 6 forms a reflective element if its length is greater than the length of the aperture e and a directive element if its length is less. Indeed, concerning the results of FIGS. 5 and 6, the gain increases by 1.3 dB with a directive element to reach 6.6 dB and reduces by 2.4 dB to reach 2.9 dB with a reflective element. FIG. 4 shows that the addition of an element 6 in the radiation beam of the antenna however leads to a degradation in the bandwidth of the antenna.

Figure 7:
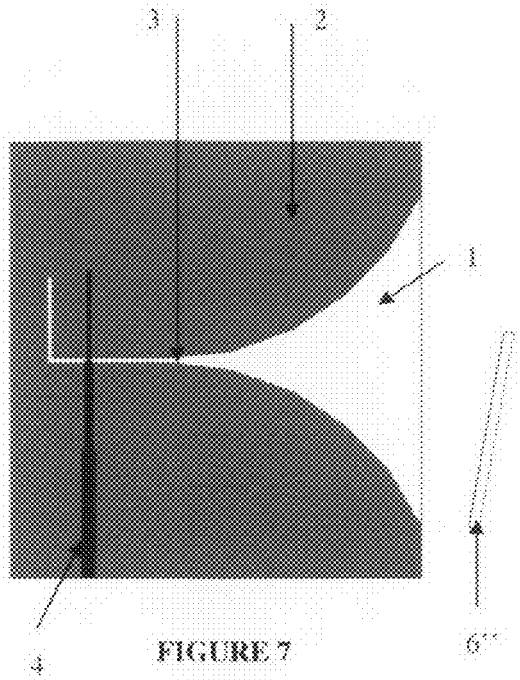
FIGS. 7 and 8 are schematic perspective views of an antenna structure in accordance with the one of FIG. 3, wherein the modification element of the radiation pattern shows different positions.
Figure 8:
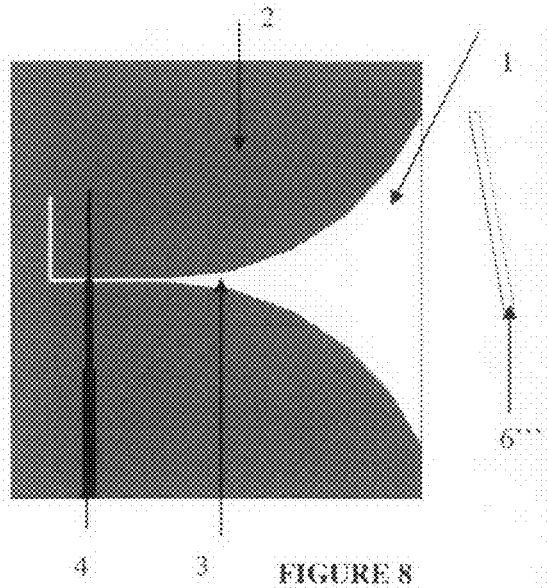
Figure 9:
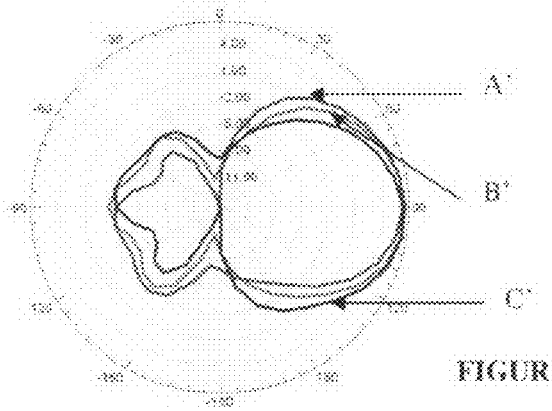
FIGS. 9 and 10 represent respectively the radiation pattern in the elevation plane and the radiation pattern in the azimuthal plane for the antenna structure of FIGS. 3, 7 and 8 with a directive element of length 20 mm shifted 100 toward the upper part (curve A'), a directive element of length 20 mm placed in the axis of the antenna (curve B') and a directive element of length 20 mm shifted 100 toward the lower part of the antenna (curve C').
Figure 10:
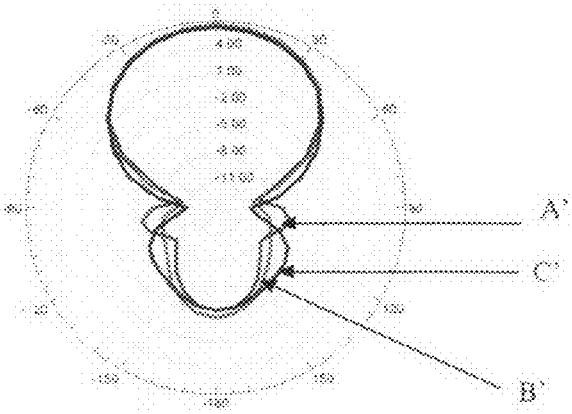

Moreover, if the position of the vertical element 6 is modified, as shown by the position of the element 6' and the position of the element 6" in FIGS. 7 and 8, the direction of the main beam can be controlled. These results are observed on the patterns obtained in FIGS. 9 and 10 respectively showing the radiation pattern in the elevation plane and in the azimuthal plane for an antenna in the presence of a directive element of length 20 mm shifted by 10° toward the upper part of the antenna, as shown in FIG. 8 (curve A') or of an antenna in the presence of a directive element of length 20 mm shifted by 10° toward the lower part of the antenna, as shown in FIG. 7 (curve C'), the curve D' giving the results obtained with an antenna in the presence of a directive element of length 20 mm positioned in the plane E, as shown in FIG. 3. The shift of the main beam B' when the directive element is shifted upward or downward is mainly confirmed by the pattern of FIG. 9 where the curves A' and C' are found on each side of the curve B'.

Figure 11:
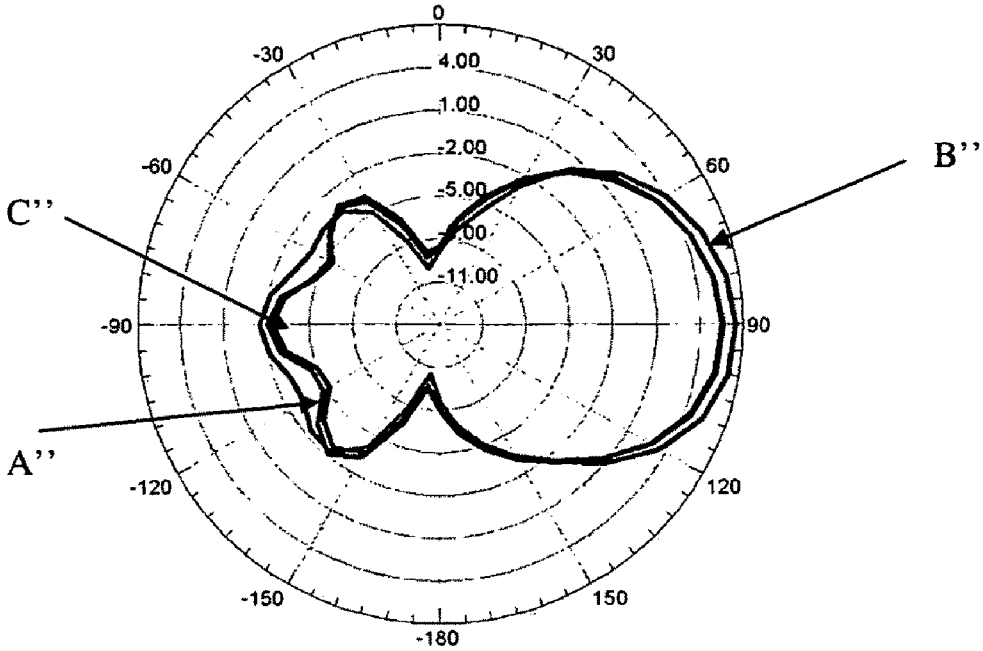
FIGS. 11 and 12 represent respectively the radiation pattern in the elevation plane and the radiation pattern in the azimuthal plane, for an antenna structure with a directive element of length 20 mm shifted 150 toward the left part of the antenna (curve A"), with a directive element of length 20 mm placed in the axis of the antenna (curve B") and with a directive element of length 20 mm shifted 150 toward the right part of the antenna (curve C").
Figure 12:
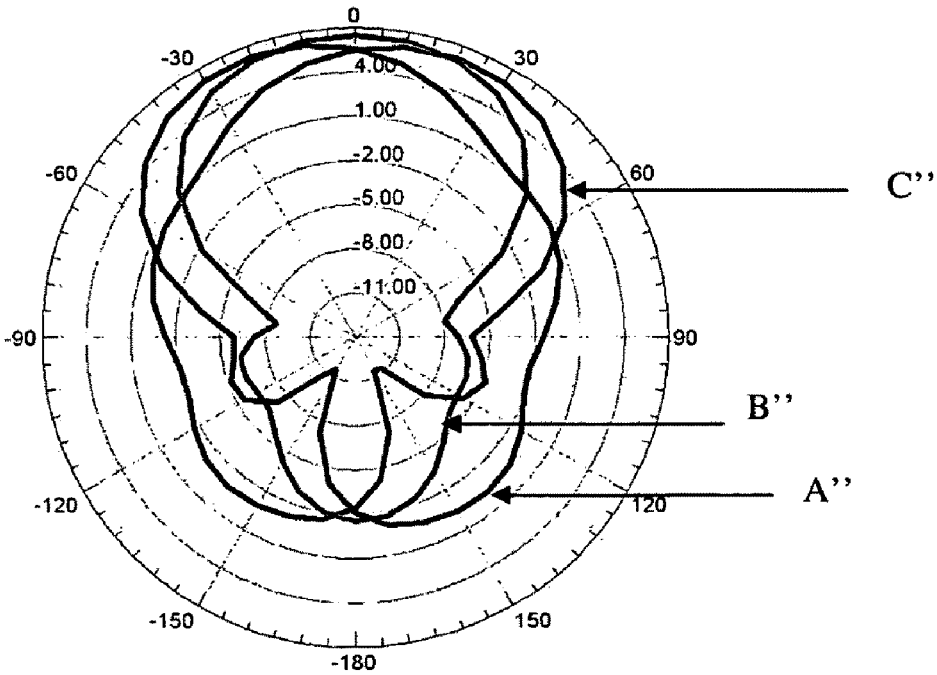

As shown in the FIGS. 11 and 12, this shift of the radiation beam is also observed when the modification element of the radiation pattern is shifted to the left part or the right part of the radiating element rather than toward the upper part or toward the lower part of the radiating element. This results notably in the curves A" and C" of FIGS. 11 and 12.

Figure 13:
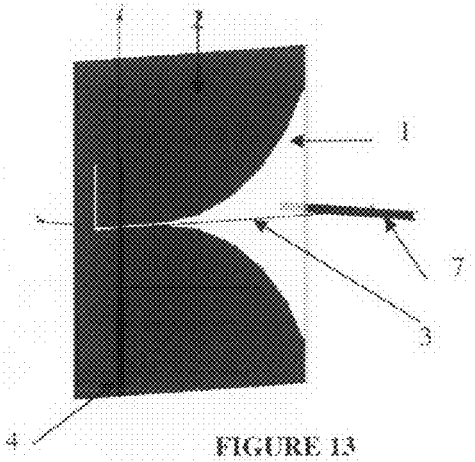
FIG. 13 schematically shows in perspective an antenna structure in accordance with the present invention with a modification element of the radiation diagram positioned according to the plane H.

According to another characteristic of the invention and as shown in FIG. 13, a modification element of the radiation parameters is constituted by a conductive rod or strip 7, more particularly a metal rod or strip, positioned according to the plane H, namely perpendicularly to the plane of the substrate of the antenna. In this case, the simulations carried out gave impedance matching curves according to the frequency shown in FIG. 14 and a radiation pattern in the azimuthal plane and in the elevation plane shown in FIGS. 15 and 16. The simulations were carried out with an element 7 of width 1 mm and length 25 mm, the parameters of the antenna being identical to those mentioned above. The curve D shows the antenna without modification element whereas the curve E shows an antenna structure in the presence of a horizontal modification element.

Figure 14:
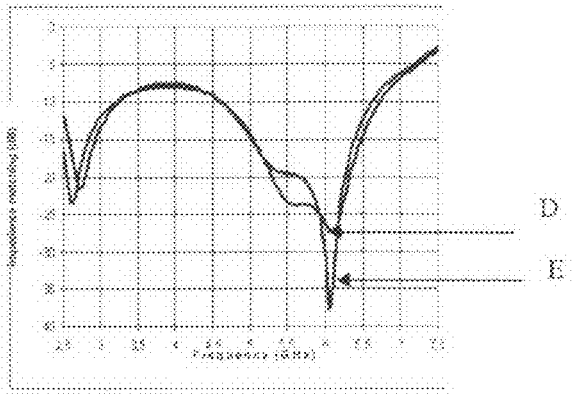
FIG. 14 shows the impedance matching curve as a function of frequency, for an antenna alone (curve D) and for an antenna structure in the presence of a horizontal directive element (curve E).
Figure 15:
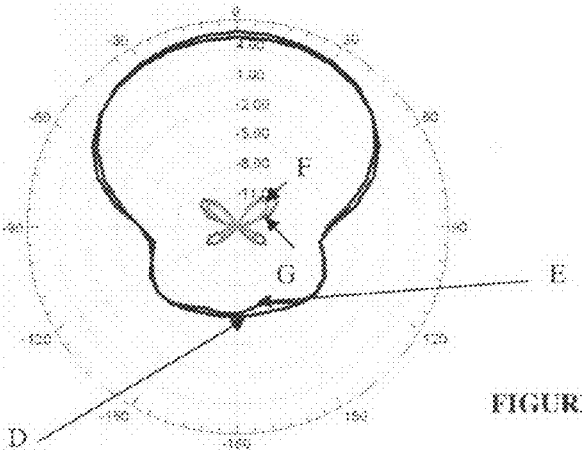
FIGS. 15 and 16 respectively show the radiation pattern in an azimuthal plane and the radiation pattern in an elevation plane for an antenna alone (curve D), for an antenna structure in the presence of a horizontal directive element (curve E), the curve F giving the cross-polarisation of the antenna alone and the curve G the cross-polarisation of the antenna structure in the presence of a horizontal directive element.
Figure 16:
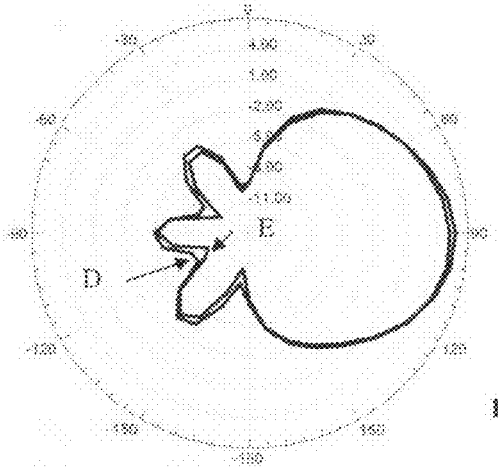
Figure 17:
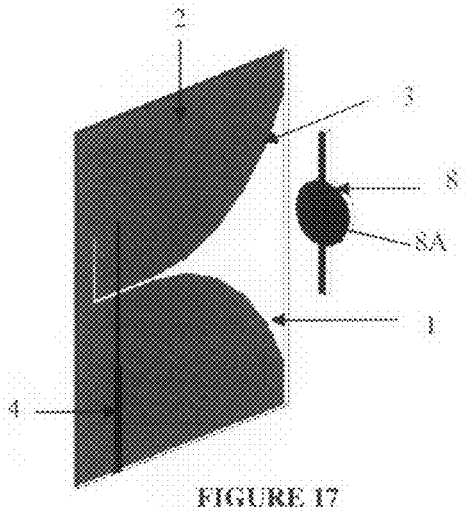
FIG. 17 is a schematic perspective view of an antenna structure having a radiating element and a modification element of the vertical radiation pattern associated with a projecting element being able to act on the impedance matching of the antenna.

According to FIGS. 15 and 16, hardly any modifications in the level of the total gain of the antenna are observed when a horizontal conductive element is placed in the beam of the radiation pattern of the antenna but a modification of the cross-polarisation is observed, more particularly a reduction in the cross-polarisation levels (curve G) without interfering with the impedance matching of the antenna of FIG. 14.

Figure 18:
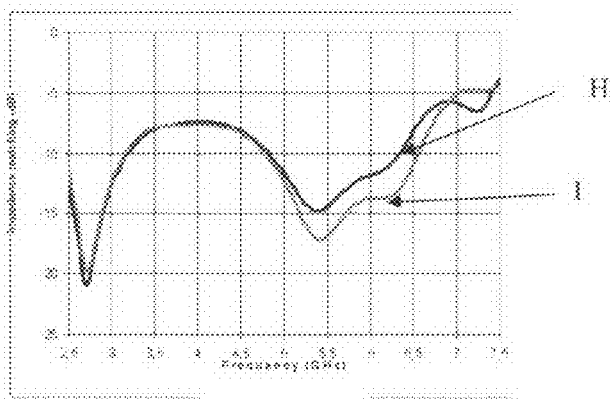
FIG. 18 shows impedance matching curves of the antenna as a function of frequency when the antenna is in the presence of a directive element of length 20 mm (curve H) and when the antenna is in the presence of a directive element of length 20 mm associated with a metal circle of radius 4 mm (curve I).
Figure 19:
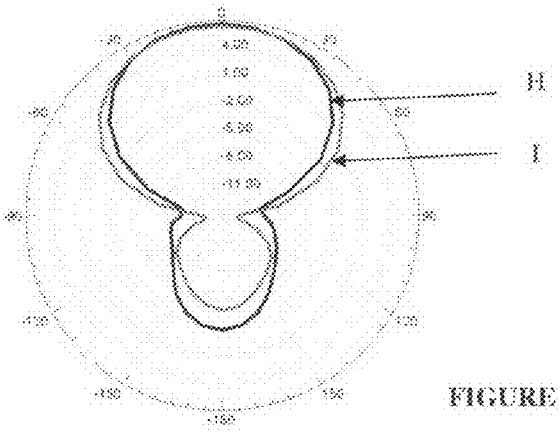
FIGS. 19 and 20 respectively show the radiation pattern in the azimuthal plane and the radiation pattern in the elevation plane for an antenna in the presence of a directive element of length 20 mm (curve H) and for an antenna in the presence of a directive element of length 20 mm associated with a metal circle of radius 4 mm (curve I).
Figure 20:
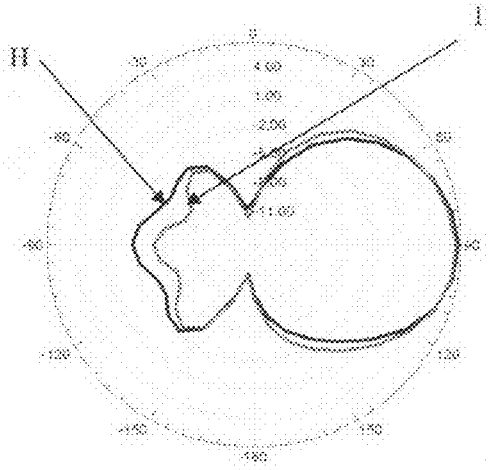

A description will now be given with reference to the FIGS. 17, 18, 19 and 20 of a modification of the vertical directive element enabling the observed degradation of the impedance matching of the antenna to be overcome. In this case, a projecting element 8*a*, more particularly a disk is inserted into the middle of the vertical metal arm 8. However, it is evident that the projecting element can have another form, such as a square or polygonal form. This element modifies the electromagnetic environment close to the aperture of radiating element and enables the bandwidth to be widened to −10 dB, as shown in FIG. 18. It also enables the backward radiation to be reduced in the order of 2 dB while retaining a maximum gain very close to the gain of the antenna associated with the vertical directive element, as shown by the pattern of FIG. 19, notably by the curve H that shows an antenna structure in the presence of a directive element of length 20 mm and the curve I that shows an antenna structure in the presence of a directive element of length 20 mm associated with a metal circle of radius 4 mm.

Figure 21:
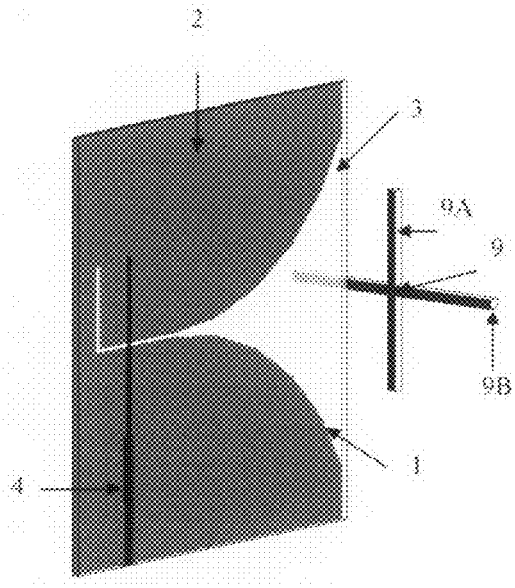
FIG. 21 shows a diagrammatic perspective view of an antenna structure comprising a radiating element associated with a modification element of the radiating pattern constituted by a vertical rod and a horizontal rod.
Figure 22:
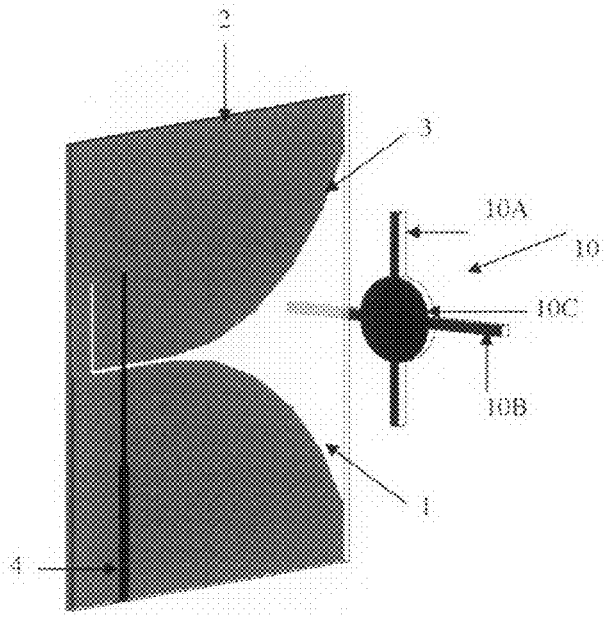
FIG. 22 shows a diagrammatic perspective view of an antenna structure comprising a radiating element, associated with a modification element of the radiating pattern formed by a vertical element, a horizontal element and a projecting element modifying the impedance matching of the antenna.
Figure 23:
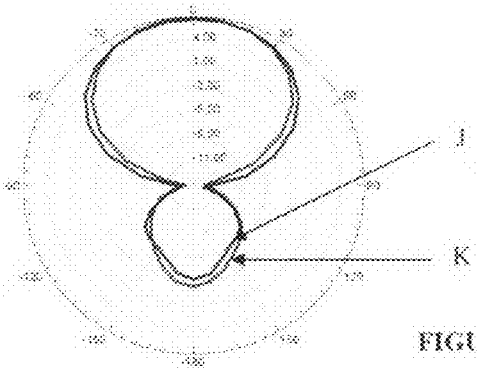
FIGS. 23 and 24 respectively show the radiation pattern in an azimuthal plane and the radiation pattern in an elevation plane of an antenna structure in the presence of a vertical directive element of length 20 mm and a horizontal element of length 25 mm associated with a central metal circle of radius 4 mm (curve J) and an antenna structure in the presence of a vertical directive element of length 20 mm and a horizontal element of length 25 mm (curve K).
Figure 24:
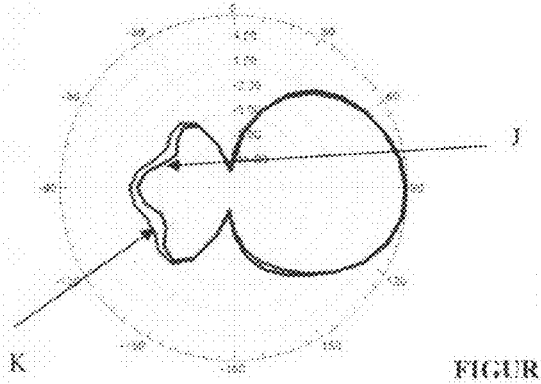

The FIGS. 21 to 24 respectively show, for FIGS. 21 and 22, two other embodiments of the modification element of the radiation pattern and for FIGS. 23 and 24, respectively the radiation pattern in the azimuthal plane and the radiation pattern in the elevation plane of the two aforementioned embodiments. In FIG. 21, the modification element 9 is constituted respectively by a vertical conductive element 9A and a horizontal conductive element 9B whereas in FIG. 22, the modification element of the radiation pattern 10 is constituted by a vertical arm 10A, a horizontal arm 10B and a projecting element formed by a circle 10C. The behaviour of these two embodiments is respectively given by the curves J for an antenna structure in the presence of a vertical directive element of length 20 mm and of a horizontal element of length 20 mm associated with a metal circle of radius 4 mm, as shown in FIG. 22 and by the curves K for an antenna structure in the presence of a vertical directive element of length 20 mm and of a horizontal element of length 25 mm for the embodiment of FIG. 21.

The patterns of the FIGS. 23 and 24 enable the improvement of the front-back ratio to be highlighted in the case of an element similar to the one of FIG. 22.

Figure 25:
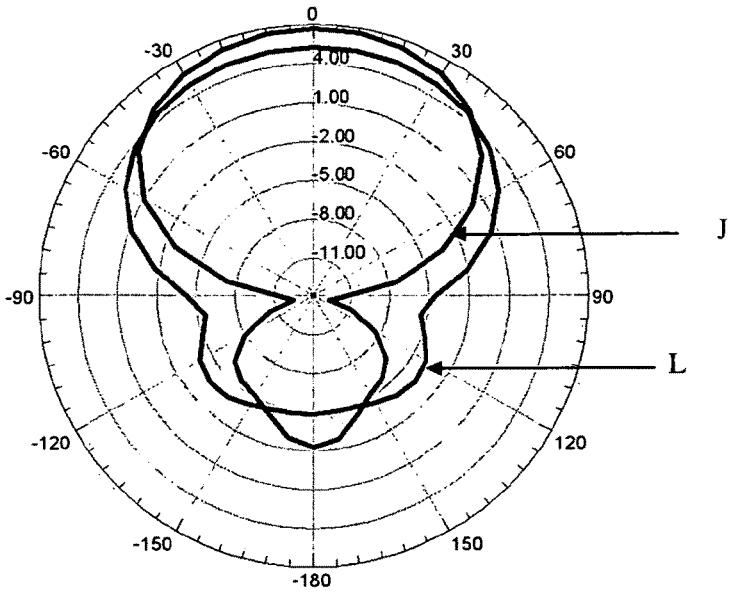
FIG. 25 shows the radiation pattern in the azimuthal plane of an antenna alone (curve L) and of an antenna structure in the presence of a vertical directive element of length 20 mm and of a horizontal element of length 25 mm associated with a central metal circle of radius 4 mm (curve J).
Figure 26:
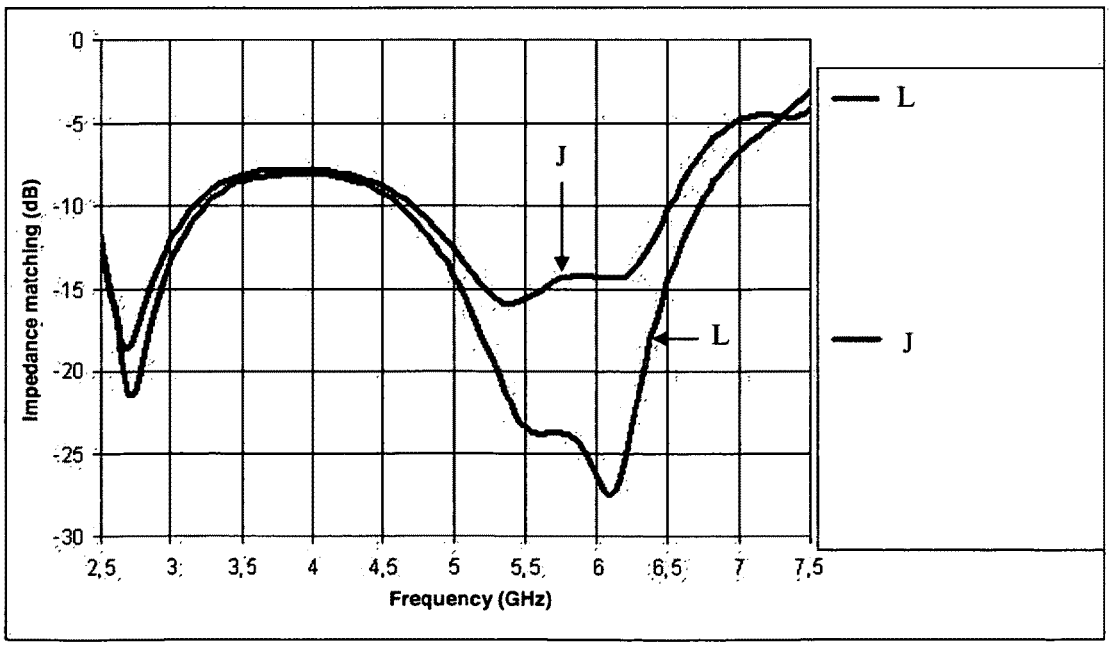
FIG. 26 shows impedance matching curves as a function of the frequency, respectively for an antenna alone (curve L) and for an antenna structure in the presence of a vertical directive element of length 20 mm and of a horizontal directive element of length 25 mm associated with a central metal circle (curve J).

The radiation pattern of FIG. 25 and the impedance matching curve of FIG. 26 show the advantages of an antenna structure featuring a modification element of the radiation pattern as shown in FIG. 22 (curve J), with respect to an antenna alone (curve L). The embodiment of FIG. 22 enables an impedance matching similar to that of an antenna alone to be obtained while improving the gain of the antenna and the direction of the main beam, and this without modifying the physical dimensions of the radiating element itself.

It is evident to those skilled in the art that the present invention also applies to the case in which several modification elements of the radiation diagram are associated with each other to form for example a network of identical or different directive elements.

A description will now be given with reference to FIGS. 27, 28 and 29 of different embodiment of the modification element of the radiation pattern.

Figure 27:
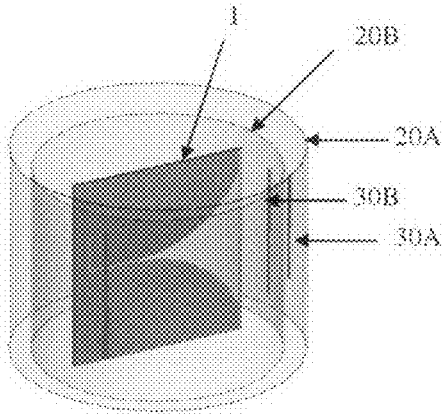
FIG. 27 shows an antenna structure with a radiating element such as shown in FIG. 3, this structure being surrounded by a radome featuring modification elements of the radiation pattern.

FIG. 27 shows an antenna structure comprising a single radiating element 1 of the type described above, this radiating element being surrounded by a radome formed by an outer cylindrical envelope 20A and an internal cylindrical envelope 20B. In this case, two vertical directive elements are positioned according to the plane E of the radiating element. These directive elements 30A and 30B are constituted by metal strips realised directly on the radome by means of a metallization technique of plastic material.

Figure 28:
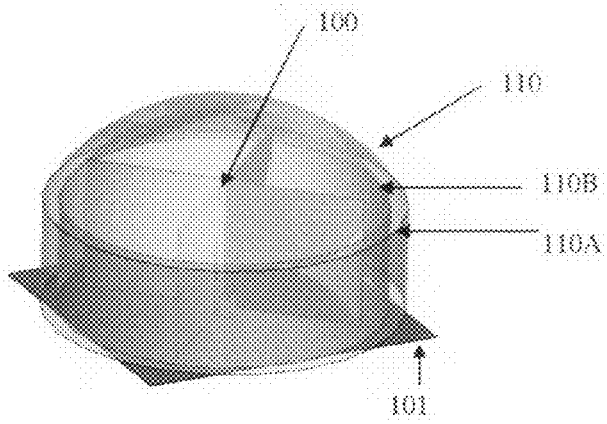
FIGS. 28 and 29 respectively show a schematic perspective view and a longitudinal cross-section view of an antenna structure comprising four interconnected radiating elements surrounded by a radome on which modification elements of the radiation pattern are mounted, in accordance with the present invention.
Figure 29:
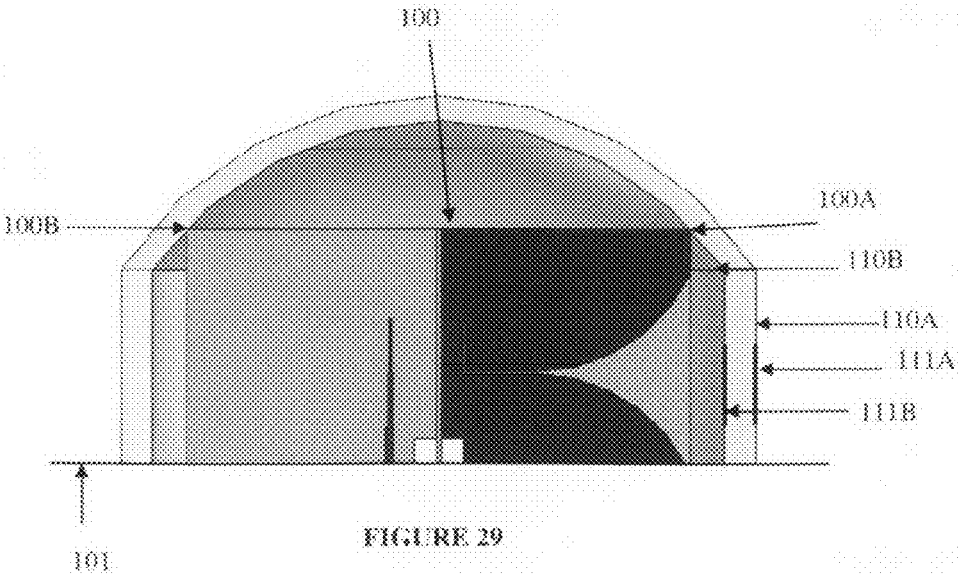

In FIGS. 28 and 29, an antenna structure 100 with four radiating elements is shown, these four elements being interconnected according to a common vertical axis. The structure of two radiating elements 100A and 100B is shown in a clearer manner in FIG. 29. The four elements are mounted on a horizontal support 101 and covered by a radome 110, formed by an outer envelope 110A and an inner envelope 110B.

As in the embodiment of FIG. 27, vertical metal directive elements 111A and 111B are etched on the outer part 110A and on the inner part 110B of the radome in the plane E of each radiating element 100A, 100B.

The present invention also applies to antenna structures protected by multilayer radomes with at least one modification element of the radiation pattern etched on each of the layers.

Other embodiments can be considered to fit modification elements of the radiation pattern. A substrate perpendicular to the substrate can be inserted, on which the radiating elements are realised and the patterns forming the modification elements of the radiation pattern are etched on this substrate.

According to another characteristic of the invention, the electric length of the modification elements of the radiation pattern can be modified by activating/deactivating switching elements such as diodes or MEMs placed between the elements for example. It is also possible to provide switching elements interconnecting several modification elements between each other. According to the conducting or non-conducting status of the switching elements, it is possible to modify the structure of the network of modification elements.

What is claimed is:

1. A planar antenna structure comprising one substrate, at least one radiating element having a radiation pattern and presenting an axis of symmetry, said radiating element being constituted by a longitudinal radiation slot and a feed line, said substrate being surrounded by at least one radome, and at least one conductive element modifying the radiation pattern being positioned on the radome in a radiating zone of the radiating element, wherein the conductive element is shifted angularly with respect to said axis of symmetry or with respect to an axis perpendicular to the axis of symmetry.

2. The structure according to claim 1, wherein the longitudinal radiation slot has an aperture of length greater than or equal to $\lambda/2$ ($\lambda$ the wavelength at the operating frequency), the conductive element forming a reflective element if its length is greater than $\lambda/2$ and a directive element if its length is less than $\lambda/2$.

3. The structure according to claim 1, wherein the longitudinal radiation slot has an aperture of length less than $\lambda/2$ ($\lambda$ the wavelength at the operating frequency), the conductive element forming a reflective element if its length is greater than the length of the aperture and a directive element if its length is less than the length of the aperture.

4. The structure according to claim 1, wherein the conductive element is constituted by a metal rod or strip.

5. The structure according to claim 1, wherein the conductive element has a projecting element acting on the impedance matching parameters of the radiating element.

6. An antenna structure comprising N (N>1) radiating elements realised on N substrates interconnected according to a common axis perpendicular to the radiating axis of each radiating element, each radiating element presenting an axis of symmetry being associated with at least one conductive element modifying the radiating pattern positioned in the radiating zone of the radiating element, wherein the conductive element is shifted angularly with respect to said axis of symmetry or with respect to an axis perpendicular to the axis of symmetry.

7. The antenna structure according to claim 6, wherein the longitudinal radiation slot has an aperture of length greater than or equal to $\lambda/2$ ($\lambda$ the wavelength at the operating frequency), the conductive element forming a reflective element if its length is greater than $\lambda/2$ and a directive element if its length is less than $\lambda/2$.

8. The antenna structure according to claim 6, wherein the longitudinal radiation slot hits an aperture of length less than $\lambda/2$ ($\lambda$ the wavelength at the operating frequency), the conductive element forming a reflective element if its length is greater than the length of the aperture and a directive element if its length is less than the length of the aperture.

9. The antenna structure according to claim 6, wherein the conductive element is constituted by a metal rod or strip.

10. The antenna structure according to claim 6, wherein the conductive element has a projecting element acting on the impedance matching parameters of the radiating element.

* * * * *